United States Patent [19]

Matsubara et al.

[11] 4,060,659

[45] Nov. 29, 1977

[54] ELECTRIC WIRES OR CABLES WITH STYRENE CONTAINING DIELECTRIC LAYER

[75] Inventors: Hironaga Matsubara; Shousuke Yamanouchi, both of Osaka, Japan

[73] Assignee: Sumitomo Electric Industries, Ltd., Osaka, Japan

[21] Appl. No.: 629,827

[22] Filed: Nov. 7, 1975

[51] Int. Cl.[2] ..... B44D 1/42

[52] U.S. Cl. ..... 428/379; 428/390

[58] Field of Search ..... 428/379, 390, 462, 463; 260/889, 897 A, 897 B; 174/110 SR, 110 SY, 110 PM

[56] References Cited

U.S. PATENT DOCUMENTS

| | | | |
|---|---|---|---|
| 3,639,163 | 2/1972 | Bishop et al. | 428/379 |
| 3,773,556 | 11/1973 | Rowland et al. | 428/379 |
| 3,894,117 | 7/1975 | Agouri et al. | 260/897 A |

*Primary Examiner*—Marion E. McCamish

*Attorney, Agent, or Firm*—Sughrue, Rothwell, Mion, Zinn and Macpeak

[57] ABSTRACT

Electric wires or cables having a dielectric layer or layers of an uncross-linked or cross-linked mixture of (1) a polyolefin and (2*a*) polystyrene or (2*b*) a styrene copolymer. The polystyrene is present in such an amount as to provide a 10 to 30% styrene content, based on the entire mixture weight, while if the styrene copolymer is used it is present in such an amount as to provide a 3 to 30% styrene content, based on the entire mixture weight. The mixture may comprise, alternatively, both polystyrene and a styrene copolymer in an amount so as to provide a 10 to 30% and a 5 to 20% styrene content, due to the former and the later, respectively, based on the entire mixture weight.

16 Claims, No Drawings

ELECTRIC WIRES OR CABLES WITH STYRENE CONTAINING DIELECTRIC LAYER

BACKGROUND OF THE INVENTION

1. Field of the Invention

The present invention relates to electric wires or cables.

2. Description of the Prior Art

Electric wires or cables having dielectric layers of polyolefins such as polyethylene, cross-linked polyethylene and the like are in wide use. Such polymers have in recent years been improved so that they are able to withstand high applied voltages. One important problem at present with such electric wires and cables is that they undergo a gradual degradation with time during under continuous applied voltages, resulting in a reduction in their capability to withstand applied voltages. Since the service life of electric wires or cables per se is as long as thirty years, the initial thickness of dielectric layers therefor must be increased over initial requirements with present designs so as to compensate for the above reduction in their ability to withstand applied voltages with the passage of time. On the other hand, recent urban development have required increased power transmission capacity for electric wires or cables while keeping volume as small as possible. This has led to the difficult problem, with electric wires or cables having a dielectric layer essentially consisting of a polyolefin, of increasing the transmission voltage without increasing the thickness of the dielectric layer.

Various approaches to overcome the above problem have been considered, including preventing the occurrence of the above described degradation, whereby the decrease in capability to withstand applied voltages during a thirty year service life need not be taken into account, and the requirements of urban areas regarding high transmission capability and low volume can be met.

SUMMARY OF THE INVENTION

The inventors, taking note of the above points, performed extensive studies on the aging of electric wires or cables of the foregoing type, and found that aging is primarily caused by trees (or electrochemical trees, as they are sometimes termed) generated in the polyolefin dielectric form voids which develop in the polyolefin dielectric material, and that the degradation described above can be avoided by preventing the generation of trees from the voids in dielectric polyolefins material while significantly decreasing the thickness of the dielectric layer.

A primary object of the present invention is thus to provide electric wires or cables in which the development of trees is prevented and longer service life is obtained.

The present invention provides electric wires or cables having a dielectric layer or layers of an uncross-linked or cross-linked mixture of (1) a polyolefin and (2*a*) polystyrene or (2*b*) a styrene copolymer. The polystyrene copolymer is present in such an amount as to provide a 10 to 30% styrene content on the basis of the entire mixture weight, while if the styrene copolymer is used it is present in such an amount as to provide a 3 to 30% styrene content on the basis of the entire mixture weight. The mixture may comprise, alternatively, both polystyrene and a styrene copolymer in an amount so as to provide a 10 to 30% and a 5 to 20% styrene content, due to the former and the later, respectively, based on the entire weight of the polymers in the mixture.

By the use of the electric wires or cables of the present invention, the disadvantages of the prior art are overcome in that the development of the trees is prevented to thereby attain service life several to several tens of times as long as that of a conventional polyolefin dielectric insulated wire or cable. As a result, we have succeeded in significantly decreasing the initial thickness of the polyolefin dielectric layer in such wires on cables.

DETAILED DESCRIPTION OF PREFERRED EMBODIMENTS

The term styrene content (%) as is used herein means the percent by weight of styrene on the weight of the entire polymer mixture. Polystyrene, for example, has a 100% styrene content, while a polyolefin blended with 30% by weight of polystyrene has a 30% styrene content. As a further example, assuming that 70 parts by weight of polyolefin is blended with 30 parts by weight of SBR which contains 50% by weight styrene, in this instance the styrene content would be 15%.

The term "polyolefin" as is used herein refers to a polyolefin which is predominantly polyethylene, which can contain, if desired, a small amount of a component such as propylene, butene, butadiene, isobutylene, etc. Preferred of such polyolefins are those which have a melt index of 0.1 or higher and a density of 0.90 to 1.0, and include both low density and high density ethylene homopolymers.

The term "polyolefin" also includes copolymers of ethylene and another comonomer other than styrene, e.g., an ethylene-vinyl acetate copolymer, an ethylene-propylene copolymer, and an ethylene-acrylate copolymer (e.g., an ethylene-methylacrylate copolymer, an ethylene-ethylacrylate copolymer), etc. preferred copolymers of ethylene and another comonomer have a melt index of 0.6 or higher and a density of 0.90 to 1.2. If desired, of course, a blend of polyolefins and olefin copolymers can be used in the present invention. An example of a system based on such is a polyethylene: styrene-butadiene rubber: ethylene-propylene rubber = 95:4:1.

It should be clear from the above discussion that the copolymer of ethylene and another comonomer include, for example, a copolymer of a polyolefin which is predominantly ethylene, e.g., polyethylene with a small amount of polypropylene with, e.g., vinyl acetate. While technically a terpolymer, such material still equivalent in this invention to a polyethylene homopolymer.

When cross-linking is desired for the dielectric layer, it can be effected through electron beam irradiation, for example, at 3 Mrad to 40 Mrad, after extrusion coating of the dielectric layer or, alternatively, through heating to activate a conventional cross-linking agent, for example, using about 2% dicumyl peroxide, with heating at 200° to 300° C or by like means after extrusion coating.

As will be apparent to one skilled in the art, the dielectric layer or layers of the electric wires or cables of the present invention can have added thereto, if desired, conventional additives such as anti-aging agents and the like in conventionally used amounts, for example, 4,4'-thiobis(6-tertbutyl-m-cresol) and N',N-di-$\beta$-naphthyl-p-phenylenediamine in an amount of 0.1 to 0.5%.

When either polystyrene or a styrene copolymer is blended alone with the polyolefin, no remarkable increase in service life can be obtained with a less than 10% styrene content, while on the other hand, with a more than 30% styrene content, the physical properties of the composition are significantly degraded, primarily failing the blending characteristics required in electric wires or cables.

When both polystyrene and one or more styrene copolymers are used, if the styrene content attributable to the polystyrene is less than 10%, and the styrene content attributable to the styrene copolymer is less than 5%, based on the entire polymer weight, a remarkable increase in service life is not achieved. On the other hand, with a more than 30% styrene content attributable to the polystyrene or with a more than 20% styrene content attributable to the styrene copolymer, the physical properties of the composition are significantly degraded, primarily the bending characteristics required in electric wires or cables. Preferred styrene copolymers are styrene-butadiene copolymers containing 20 to 80% styrene. Preferred polystyrenes are those having a low melting point; most styrene copolymers used contain at least about 10% styrene.

Preferred cross-linked materials used in the present invention have a degree of gellation of from about 70% to about 95%.

The present invention will now to be described with reference to preferred embodiments and several comparison examples.

EXAMPLES

Onto twisted conductors 100 mm² in cross section, an inner semiconductor layer of a thickness of about 0.8 mm was extruded at 120° C and then compositions comprising various compounds as shown in Tables 1 and 2 were extruded at 120° C (2 mm thickness) thereover to provide electric wires or cables. As is shown in Tables 1 and 2, where cross-linking by electron beam irradiation is desired, it is effected in a conventional manner at 30 Mrad after extrusion. When chemical cross-linking is desired, a cross-linking agent or agents is/are is blended with the composition prior to extrusion and cross-linking effected by heating at 200° after extrusion coating.

The electric wires or cables thus obtained were immersed in water at 70° C, a 20 KV AC voltage applied thereto, and kept under these condition for a certain period of times. The development of trees was examined and the time required for dielectric breakdown in the insulating layers determined relative to the standard of a polyethylene layer (melt index: 1.0, density: 0.92) set as "1". The results are shown in Tables 1 and 2.

In Table 1, polystyrene or a styrene copolymer was used, as indicated therein, whereas in Table 2, polystyrene plus styrene copolymer were used, as indicated therein.

Table 1

| | Olefin Polymer | Styrene Polymer | Styrene Content** (%) | Cross-linking | Trees*1 | Physical*2 Properties | Breakdown Time |
|---|---|---|---|---|---|---|---|
| Comparison Example 1 | LDPE*3 | — | — | None | X | | 1 |
| 2 | " | Polystyrene | 5 | " | X | | 1.1 |
| Example 1 | " | " | 10 | " | | | 2.3 |
| 2 | " | " | 20 | " | | | 11 |
| 3 | " | " | 30 | " | | | 15 |
| Comparison Example 3 | " | " | 40 | " | | X | 15 |
| Example 4 | " | " | 30 | Effected*11 | | X | 14 |
| 5 | " | " | 30 | Effected*12 | | | 9 |
| Comparison Example 4 | " | SBR*4 | 1 | None | X | | 1.3 |
| Example 6 | " | " | 3 | " | | | 3.1 |
| 7 | " | " | 3 | Effected*11 | | | 3.2 |
| 8 | " | " | 5 | " | | | 5.3 |
| 9 | " | " | 7 | " | | | 6.8 |
| Comparison Example 5 | LDPE*3 | SBR*5 | 1.4 | Effected*11 | X | | 1.8 |
| Example 10 | " | " | 7 | " | | | 7.1 |
| 11 | " | " | 9 | " | | | 11.0 |
| 12 | " | " | 20 | Effected*12 | | | 8.7 |
| 13 | " | Et-St*6 | 20 | " | | | 11 |
| 14 | " | ABS*7 | 5.4 | Effected*11 | | | 4.8 |
| 15 | " | " | 10 | None | | | 10.1 |
| 16 | " | ACS*8 | 4.5 | Effected*11 | | | 5.0 |
| 17 | " | " | 10 | None | | | 9.1 |
| 18 | HDPE*9 | SBR*5 | 7 | Effected*11 | | | 9.8 |
| 19 | " | Polystyrene | 10 | None | | | 15 |
| 20 | EVA:*10 VA 5% | SBR*4 | 4.6 | Effected*11 | | | 9.1 |
| 21 | EVA:*10 VA 10% | Polystyrene | 10 | None | | | 6.5 |

**Based on polymer mixture weight

Table 2

| | Olefin Polymer | Styrene Content in Styrene Polymer (%) | Styrene Content in Polymer Mixture Due to Styrene Copolymer** (%) | Cross-linking | Trees*1 | Physical*2 Properties | Breakdown Time |
|---|---|---|---|---|---|---|---|
| Example 22 | LDPE*3 | 20 | SBR*5 5 | None | | | 7 |
| 23 | " | 20 | SBR*5 10 | " | | | 6.4 |
| 24 | " | 20 | SBR*5 20 | " | | | 8.0 |

Table 2-continued

| | Olefin Polymer | Styrene Content in Styrene Polymer (%) | Styrene Content in Polymer Mixture Due to Styrene Copolymer** (%) | Cross-linking | Trees*1 | Physical*2 Properties | Breakdown Time |
|---|---|---|---|---|---|---|---|
| Comparison | | | | | | | |
| Example 6 | " | 20 | SBR*5 30 | " | | X | 8.1 |
| Example 25 | " | 30 | SBR*5 20 | " | | | 7.4 |
| 26 | " | 20 | SBR*5 10 | Effected*11 | | | 6.2 |
| 27 | HDPE*9 | 20 | SBR*5 10 | None | | | 15 |
| 28 | EVA*10 VA:10% | 20 | SBR*5 10 | " | | | 7 |
| 29 | LDPE*3 | 20 | Et-St*6 10 | " | | | 6 |

**Based on polymer mixture weight
*1The test specimens were removed from the water after the application of the applied voltage and microscopically examined to observe the development of trees.
X : Considerable development of the trees
: No substantial development of the trees
: No development of the trees
*2Determined by tensile testing using dumbbells according to JIS-3 (modified)
: With more than 200% elongation
X : With less than 200% elongation
*3Low density polyethylene: M.I. = 1.2 and $\rho$ = 0.92
*4SBR : styrene-butadiene copolymer; styrene content : 23%
*5SBR : styrene-butadiene copolymer; styrene content : 70%
*6Et-St : graft copolymer of polyethylene and polystyrene
*7ABS : acrylonitrile-butadiene-styrene copolymer
*8ACS : acryloitrile-chlorinated ethylene-styrene copolymer
*9HDPE : high density polyethylene with M.I. = 0.2 and $\rho$ = 0.96
*10EVA : ethylene-vinyl acetate copolymer
*11Cross-linked by electron beam irradiation
*12Chemically cross-linked by heating blend of polymers with 2 parts by weight of dicumyl peroxide therein as a cross-linking agent per 100 parts by weight of the polymer mixture.

While the invention has been described in detail and with reference to specific embodiments thereof, it will be apparent to one skilled in the art that various changes and modifications can be made therein without departing from the spirit and scope thereof.

What is claimed is:

1. Electric cables or wires having at least one dielectric layer consisting essentially of (1) of polyolefin and 2*a*. polystyrene, wherein for polymer composition (1)–(2a) the polystyrene is present in such an amount as to provide a 10 to 30% styrene content;

2*b*. a styrene copolymer, wherein for polymer composition (1)–(2*b*) the styrene copolymer is present in such an amount as to provide a 3 to 30% styrene content; or 2*c*. polystyrene and a styrene copolymer, wherein for polymer composition (1)–(2*c*) the polystyrene is present so as to provide a 10 to 30% styrene content and the styrene copolymer is present in such an amount so as to provide a 5 to 20% styrene content; all percentages being based on the entire polymer composition weight.

2. Electric cables or wires as claimed in claim 1, wherein said mixture is cross-linked.

3. Electric cables or wire as claimed in claim 2, wherein the degree of cross-linking is represented by a degree of gellation of about 70 to about 95%.

4. Electric cables or wires as claimed in claim 1, wherein said mixture is not cross-linked.

5. Electric cables or wires as claimed in claim 1, wherein said polyolefin is a polyethylene homopolymer of a density of 0.92 and melt index of 1.0.

6. Electric cables or wires as claimed in claim 1, wherein said polyolefin is an ethylene-vinyl acetate copolymer of a density of 0.93 and a vinyl acetate content of 5 wt.%.

7. Electric cables or wires as claimed in claim 1, wherein said styrene copolymer is a styrene-butadiene copolymer containing 20 to 80 wt.% styrene.

8. Electric cables or wires as claimed in claim 1, wherein said at least one dielectric layer consists essentially of said polymer composition (1)–(2*a*).

9. Electric cables or wires as claimed in claim 1, wherein said at least one dielectric layer consists essentially of said polymer composition (1)–(2*b*).

10. Electric cables or wires having at least one dielectric layer consisting essentially of a polyolefin, polystyrene and a styrene copolymer, the polystyrene and styrene copolymer being present in such amounts as to provide a 10 to 30% styrene contents from the polystyrene and a 5 to 20% styrene content from the styrene copolymer, respectively, based on the entire polymer mixture weight.

11. Electric cables or wires as claimed in claim 10, wherein said mixture is cross-linked.

12. Electric cables or wires as claimed in claim 11, wherein the degree of cross-linking is represented by a degree of gellation of about 70 to about 95%.

13. Electric cables or wires as claimed in claim 10, wherein said mixture is not cross-linked.

14. Electric cables or wires as claimed in claim 10, wherein said polyolefin is a polyethylene homopolymer of a density of 0.92 and a melt index of 1.0.

15. Electric cables or wires as claimed in claim 10, wherein said polyolefin is an ethylene-vinyl acetate copolymer of a density of 0.93 and a vinyl acetate content of 5 wt.%.

16. Electric cables or wires as claimed in claim 10, wherein said styrene copolymer is a styrene-butadiene copolymer containing 20 to 80 wt.% styrene.

* * * * *